United States Patent [19]

Vos

[11] 4,017,017

[45] Apr. 12, 1977

[54] CORRUGATED LUGGAGE

[75] Inventor: Hendrikus Vos, Winnipeg, Canada

[73] Assignee: Domtar Limited, Montreal, Canada

[22] Filed: June 28, 1976

[21] Appl. No.: 700,443

[52] U.S. Cl. ..... 229/38; 229/52 B; 229/8; 229/DIG. 3

[51] Int. Cl.[2] ..... B65D 5/10; B65D 5/46; B65D 25/28

[58] Field of Search ..... 229/52 B, 17 R, 38, 229/8, 22

[56] References Cited

UNITED STATES PATENTS

| | | | |
|---|---|---|---|
| 1,141,489 | 6/1915 | Richardson | 229/38 |
| 2,067,998 | 1/1937 | Williamson | 229/8 X |
| 2,523,246 | 9/1950 | Elliott et al. | 229/38 |
| 2,714,982 | 8/1955 | Strauss | 229/52 B X |
| 3,096,012 | 7/1963 | Bryant et al. | 229/52 B |
| 3,145,898 | 8/1964 | Struble | 229/8 |
| 3,251,532 | 5/1966 | Hecthman et al. | 229/DIG. 3 |
| 3,403,839 | 10/1968 | Farquhar | 229/52 B |
| 3,581,974 | 6/1971 | Freeman | 229/52 B |

FOREIGN PATENTS OR APPLICATIONS

| | | | |
|---|---|---|---|
| 1,259,492 | 3/1961 | France | 229/52 B |
| 729,135 | 12/1966 | Italy | 229/52 B |

*Primary Examiner*—Davis T. Moorhead
*Attorney, Agent, or Firm*—C. A. Rowley

[57] ABSTRACT

A carton blank and carton formed therefrom when the blank is provided with scorelines defining in each side panel a trapezoid and a plurality of triangles to form a blank that may be set up either with rectangular side panels or with trapezoid side panels. It is also possible with the present invention to select two different top closure structures which permits variation in length of the carton whether set up with regular rectangular side panels or with trapezoid side panels.

4 Claims, 12 Drawing Figures

CORRUGATED LUGGAGE

The present invention relates to a blank and a carton formed therefrom. More specifically the present invention relates to a blank adapted to form a carton of a selected one of plurality of different shapes and sizes.

Many airlines supply their passengers with corrugated containers for receiving and protecting suits and the like and with another container for holding miscellaneous articles to facilitate checking and handling of such suits and articles by the airline baggage system. This necessitates storing at least several size blanks in the checking area so that the attendants may erect a carton of the required size by selecting the appropriate blank. Obviously, it would be considerably more convenient if a single blank could be used to form various sized cartons as necessary for these varied applications.

It is thus the main object of the present invention to provide a carton blank adapted to form a carton of a selection one of a plurality of various sizes and shapes.

Broadly, the present invention relates to a carton blank and carton formed therefrom comprising a first end wall panel, a first side wall panel, a second end wall panel, and a second side wall panel interconnected by a set substantially parallel fold lines, each of said side wall panels being divided by a plurality of fold lines arranged substantially in the same pattern in each of said side wall panels, each said plurality of foldlines dividing its respective said side wall panel into a central trapezoid panel having two sides substantially parallel and forming the top and bottom of each of said side wall panels and a pair of legs interconnecting the adjacent ends of said two sides and converging towards each other at the same angle from said top, each said leg forming one side of a first triangle defined in said side wall panel by said bottom and an adjacent of said set of fold lines, bottom closure means foldable connected to said bottom of said side walls and to the bottom of said end walls by first bottom fold line means extending substantially perpendicularly to said set of fold lines, a second bottom fold line means spaced above and substantially parallel to said first bottom fold line means, a further fold line substantially parallel to said set of fold lines and extending from the junction of each said legs with said second bottom fold line means to said bottom fold line means.

Preferably, each of said legs between said first and said second bottom fold line means are formed by frangible lines of weakness.

It is also preferred to form the top with two different closure means each of which provdes a handle but changes the overall height of the carton.

Further features objects and advantages will be evident from the following detailed description of the preferred embodiment to the present invention taken into conjunction with the accompanying drawings in which.

Figure 1:
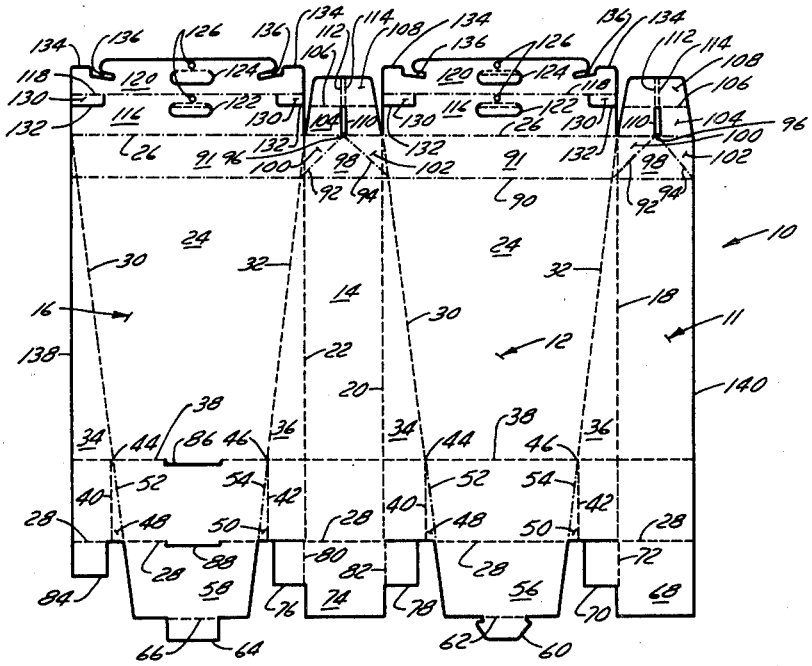
FIG. 1 is a plain view of a blank adapted from the present invention.

Referring to FIG. 1 the blank 10 comprises a first end panel 11, a first side panel 12, a second end panel 14 and a second side panel 16 foldably interconnected by a set of substantially parallel fold lines 18 and 20 and 22.

The fold line patterns on panels 12 and 16 are substantially the same and thus the same reference numerals have been applied to corresponding of these fold lines and the description will only deal directly with panel 12.

Each of the panels 12 and 16 is divided into a trapezoidal central panel 24 having parallel ends at top and bottom of the panel 12 formed by the fold lines 26 and 28 respectively. The parallel ends of the trapezoid 24 are interconnected by a pair of legs formed by fold lines 30 and 32 which extended from the fold line 26 to the fold line 28 and converge towards each other at substantially the same angle to the fold line 26. It will be noted that the fold lines 30 and 32 combined with the fold lines 18 and 20 respectively and with the bottom edge of the panel 12 form a first pair of triangles 34 and 36.

A second bottom fold line 38 formed across the blank 10 is substantially parallel to the fold line 26 and 28 and positioned therebetween. A pair of fold lines 40 and 42 extend to the fold line 28 from the junctions 44 and 46 of the lines 30 and 32 respectively with the line 38 and are substantially parallel to the set of fold lines 18, 20 and 22 to define with the legs 30 and 32 and the bottom edge of the panel 12 a second pair of triangles 48 and 50. Preferably the legs 30 and 32 between the junctions 44 and 46 respectively and the fold line 28 are formed by flangible lines of weakness so the blank may be broken along these lines indicated at 52 and 54 to permit the change of shape of the carton as will be described herein below.

Foldably connected to the bottom of the panels 12 and 16 via fold line 28 are bottom closure flaps 56 and 58 respectively. The flap 56 is provided with a locking tab 60 connected thereto by a fold line 62 and adapted to cooperate with locking slots to be described herein below. The flap 58 is provided with a simple extension flap or reinforcing flap 64 connected thereto by a fold line 66.

The end panel 12 has an end closure flap 68 connected thereto by fold line 28 and the end closure flap 68 is provided with a lateral or side flap 70 connected thereto via fold line 72.

In the illustrated arrangement the end wall panel 14 has a bottom closure flap 74 connected thereto by fold line 28 and this bottom closure flap 74 is provided with a pair of lateral side closure flaps 76 and 78 folably connected thereto by fold lines 80 and 82 respectively.

The fold lines 72, 80 and 82 are extensions of the fold lines 18, 22 and 20 respectively.

Since the edge of the flap 68 forms the edge of the carton it is not provided with a lateral flap equivalent to flap 78. However, a flap 84 is foldably connected to the bottom edge of the panel 60 under the triangular section 34 via fold line 28 as illustrated.

It will be noted that the panel 16 and closure flap 58 are provided with cuts 86 and 88 respectively adjacent the fold lines 38 and 28 respectively. The cuts 86 and 88 adapted to form slots at the bottom of the erected carton to co-operate with the locking tab 60 in a manner to be described in more detail herein below.

The arrangement of the bottom closure flaps and lateral flaps is not essential but is a preferred mode of construction.

The top of the blank 10 is formed to permit two separate and distinct handle structures to be formed as selected which in turn results in two different lengths of carton. To obtain this structure the blank 10 is formed with a second top fold line 90 substantially parallel to the fold line 26 and extending across all the panels 11, 12, 14 and 16 and which forms top panels 91 in the panels 12 and 16 between fold lines 26 and 90.

Each of the end wall panels 14 is provided with a pair of diagonal fold lines 92 and 94 extending from the mid point 96 of each of these panels on the fold line 26 toward the junction of the fold lines 90 with the side edges of these panels. In the illustrated arrangement the lines 92 and 94 extend across the fold lines 18, 20 and 22 to a position within the triangular area defined by the fold lines 18, 32 and 90; 20, 30 and 90; or 22, 32 and 90 and preferably to the junction of the line 90 with the fold lines 32 and 30. Thus each of the end panels 11 and 14 in the area between the fold lines 90 and 26 is divided into three triangular sections 98, 100 and 102.

Connected to the top of the end panels 11 and 14 by the fold line 26 is a first locking flap 104 which has connected to its free edge via fold line 106 a second locking flap 108. A cutout 110 is formed in the central portion of each of each the flaps 104 between the fold lines 26 and 106 and a pair of fold lines 112 and 114 extend across the flaps 108 from lines 106 to the free edge thereof and are a substantially projections from opposite sides of the slots 110.

Connected to the top of each of the panels 12 and 16 are first top closure flaps 116 which in turn have connected along their free edges via fold lines 118 a handle flap 120. These flaps 116 and 120 are provided with slits or cut outs 122 and 124 adapted to form hand holes in the erected carton and will be described in more detail herein below.

If desired all of these hand hole forming slits 22 and 24 may be completely severed to provide an opening but preferably handle forming structures in flaps 116 and in the flap 120 directly above the panel 12 are formed by U-shaped slits and fold lines connected to the ends of these U-shaped slits to provide a more comfortable handle grip.

It will also be noted that each of these panels 116 and 118 is provided with an aperture 126 adapted to receive coat hanger and the like.

Tabs 130 are formed adjacent each lateral side edge in the flaps 116 by L-shaped lines of severance 132. Projections 134 extend upwardly adjacent each side edge of the flaps 120. Each of these projections 134 is defined on one side by a locking slot 136.

In the illustrated arrangement no manufactures joint forming flap as has been shown on the blank. However one may be provided at either lateral edge 138 or 140 on the blank. Alternatively the blank may be formed into a knock down tube by a tape joint (not shown) taping these two lateral edges 138 and 140 together.

Figure 2:
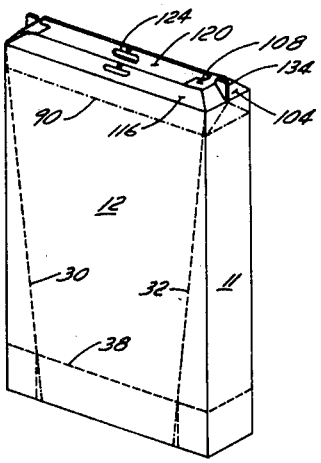
FIG. 2 is an isometric view of the carton erected in one form in accordance with the present invention.

The carton in one of its erected forms is shown in FIG. 2. In this arrangement bottom closure is made along the fold line 28, and the top is closed along the fold line 26.

Figure 3:
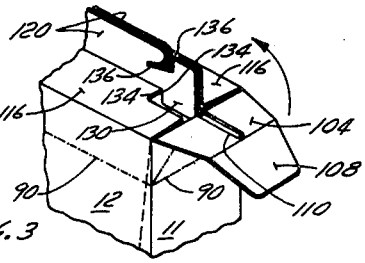
FIGS. 3 and 4 are isometric views of one mode of closing the top of the container.
Figure 4:
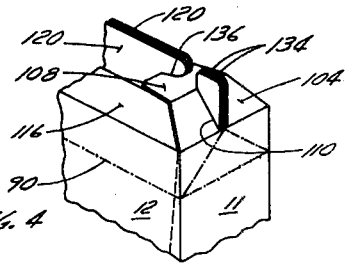

To close the top after the sleeve is opened into the shape shown in FIG. 2 i.e. the rectangular shape cross section the flaps 120 are folded substantially perpendicularly to the flaps 116 and then the flaps 116 are folded in substantially perpendicular to the panels 12 and 16 by folding on fold line 26 which brings the panels 120 into face-to-face relationship substantially in the manner shown in FIG. 3. Next the flaps 104 and 108 are folded on fold line 26 and 106 so that the flaps 108 may be slid into the locking slots formed by the combined locking slots 136 in the two flaps 120 and the projections 134 are received within the slots 110 in the flaps 104 as shown in FIG. 4.

Figure 5:
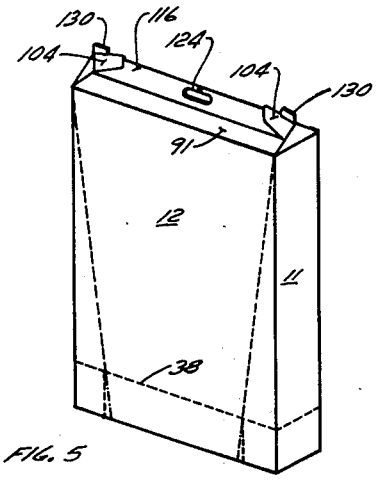
FIG. 5 is an isometric view of the carton set up utilizing a second top closure construction.
Figure 6:
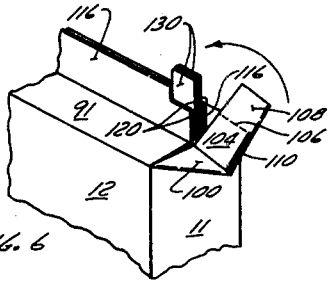
FIGS. 6 and 7 are partial isometric views illustrating the steps in locking the carton top in the setup position of FIG. 5.
Figure 7:
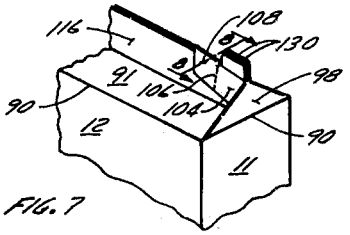
Figure 8:
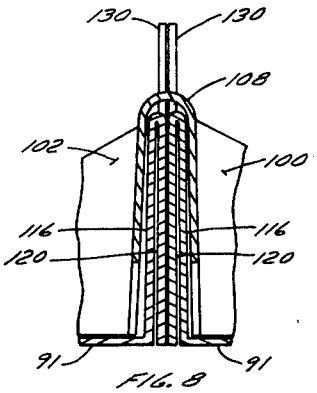
FIG. 8 (Third sheet) is a section along 8—8 of FIG. 7.

Alternatively the top closure may be formed in the manner illustrated in FIGS. 5 to 8 inclusive to provide a four thickness handle formed by the flaps 116 and 120 of both of the panels 12 and 16. In this arrangement the flaps 120 are folded along fold line 118 into face-to-face relationship with flaps 116 of each panel 12 and 16 and these flaps 116 and 120 are folded into a position substantially perpendicular with the walls 12 and 16 by folding along the fold lines 26. Next the top panels 91 are folded into a position substantially perpendicular to the walls 12 and 16, by folding along the line 90 which necessitates folding outwardly of the triangular section 98 in the panels 11 and 14 by folding along the fold line 90 and folding inwardly of the triangular sections 100 and 102 by folding inwardly along the lines 92 and 94 to provide a structure substantially as shown in FIG. 6. The folding of the flaps 120 into face-to-face relationship with the flaps 116 causes the projection 130 to pop out of the flaps 116 into the position as illustrated in FIG. 6, 7 and 8.

It will be noted that folding triangular sections into the configuration of FIG. 6 by folding along the fold lines 90, 92 and 94 also requires that the flaps 104, 108 be folded in to opposed parallel relationship by folding along the fold lines 112 and 114 and along opposite sides of the aperture 110. It thus becomes an easy matter to fold the triangular sections 98, 100 and 102 and the folded over flaps 104 and 108 so that the flaps 116 and 120 are received between the opposed side of the flaps 104 and 108 and the projections 130 project through the apertures 110 as shown in FIG. 7 and 8.

Figure 9:
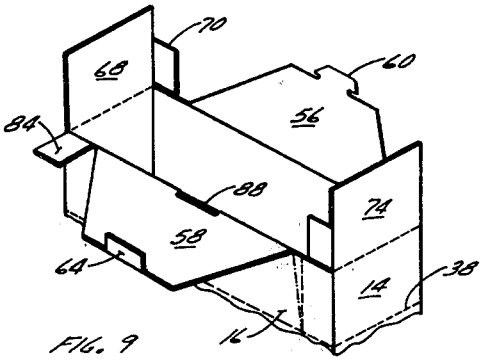
FIG. 9 is an isometric view of the bottom of the carton of FIGS. 2 and 5 showing a preliminary step to closure of the bottom.
Figure 10:
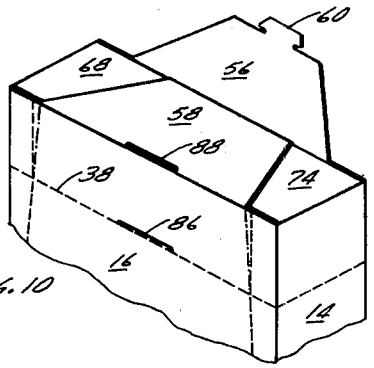
FIG. 10 illustrates the bottom structure of FIG. 9 substantially closed.

The bottom structure with a carton shape illustrated in FIGS. 2 and 5, is in the illustrated in FIG. 9 and 10. As illustrated in FIG. 9 first the flap 84 is folded perpendicular to the wall 16 and the flap 70 perpendicular to the flap 68 and then the flap 68 and 70 are folded into a position perpendicular to the wall 11. Similarly the flaps 76 and 78 are folded substantially perpendicular to the flaps 74 and the flap 74 is then folded perpendicular in the wall 14 (the flap 70, 76 and 78 are received in the carton structure). Next the projection 64 is folded perpendicular to the flap 58 and these elements are then folded in overlying relationship with the flaps 68 and 74 with the projection 64 within the carton and shown in FIG. 10. Next the locking tab 60 is folded relative to the flap 56 and then the flap 56 is folded over flap 58 and the locking tab 60 is inserted into the aperture formed by the slit 88 positioned along the fold line 28 to lock the bottom in closed position.

Figure 11:
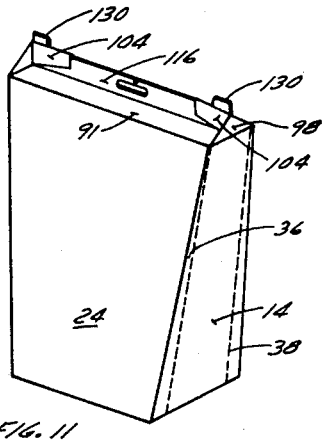
FIG. 11 is an isometric illustration of the carton set up with the top closure of FIG. 5 but in the form a shorter and different shaped carton structure.
Figure 12:
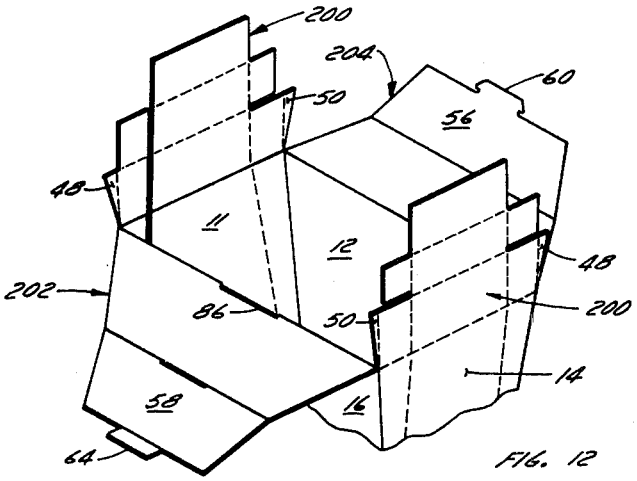
FIG. 12 is a bottom isometric view similar to FIG. 9 illustrating the bottom of the carton of FIG. 11 prior to closure.

To construct the box in the form illustrated in FIG. 11 instead of folding along the fold lines 18, 20 and 22 the box is folded along the lines 30 and 32 and the portions of the lines 30 and 32 between the fold lines 38 and 28 (portions 52 and 54) are cut or broken so that the bottom configuration is substantially as shown in FIG. 12.

To close this structure first the triangular sections 48 and 50 are folded into a position substantially perpendicular to the end wall forming sections which include the triangualr sections 34 and 36 together with the panels 14 or 11. Next, the whole bottom closuRe panel units which are illustrated in FIG. 12 at opposite ends of the carton by reference numeral 200 are folded into a position substantially parallel to the fold line 38, by folding along fold line 38. Next the projection 64 is folded relative to the flap 58 which combines with the portion of the trapezoid section 24 between the fold lines 38 and 28 to form a second bottom closure member 202 and this bottom closure member 202 is folded into overlying relationship with units 200. Next a second bottom closure member formed by the flap 56 and the portion of the trapezoid panel 24 in the panel 11 positioned between the fold lines 28 and 38 and identified in FIG. 12 by the reference numeral 204 is folded into overlying relationship with the number 202 and the locking tab 60 is tucked through the aperture formed by the cut 86 to lock the bottom in closed position.

FIG. 11 embodiment is shown with a top closure of FIG. 5. However it is equally well to be erected using the top closure structure of FIG. 2.

Modifications will be evident to those skilled in the art without departing from the spirit of the invention as defined in the appended claims.

I claim:

1. A carton blank and a carton formed therefrom comprising a first end wall panel and a first side wall panel, a second end wall panel and a second side wall panel interconnected by a set of substantially parallel fold lines, each of said side wall panels being divided by a parallity of fold lines arranged substantially in the same pattern in each of said side panels, each said plurality of fold lines defining in its respective said side wall panel, a central trapezonal panel having two sides substantially parallel and forming the top and bottom of said side wall panels and a pair of legs interconnecting adjacent ends of said two parallel sides and converging toward each other at the same angle from said top, each of said legs forming one side of a triangle defined by said bottom end and an adjacent fold line of said set of fold lines, closure means connected to said bottom of said side panels and to said end wall panels by a first bottom fold line means substantially perpendicular to said set of fold line, a second bottom fold line spaced above and substantially parallel to said first bottom fold line means, further fold lines substantially parallel to said set of fold lines and extending from the junction of each of said legs with said second bottom fold line to said bottom fold line means.

2. A blank and carton formed therefrom as defined in claim 1 wherein said legs between said first fold line means and second bottom fold line are formed by frangible lines of weakness.

3. Blank and carton formed therefrom substantially defined in claim 1 further comprising top closure means foldably connected to the top of said side and end wall panels via a first top fold line substantially parallel to said bottom fold line, a second top fold line spaced downwardly from first top fold line, diagonal score lines extending across each of said end wall panels from the mid point of said end wall panel on said first top fold line toward each corner formed on said end wall panel by the junction of said second fold line with the sides of said end wall panels.

4. A blank or carton formed therefrom substantially as defined in claim 3 further comprising handle forming means provided in top closure means and including tabs projecting from the portion of said top closure means directly connected to said side panels and slots in the portion of said top closure means directly connected to said end wall panels, said slots being adapted to receive said projections when said top is in closed position.

* * * * *